US005913513A

United States Patent [19]

Surya

[11] Patent Number: 5,913,513

[45] Date of Patent: Jun. 22, 1999

[54] ADD-ON MODULAR PAPER MOVER

[75] Inventor: Ronald Surya, Laguna Hills, Calif.

[73] Assignee: Troy Systems, Inc., Santa Ana, Calif.

[21] Appl. No.: 08/861,682

[22] Filed: May 22, 1997

[51] Int. Cl.[6] ..... B65H 5/06

[52] U.S. Cl. ..... 271/272; 271/176; 271/265.01; 271/314

[58] Field of Search ..... 271/176, 265.01, 271/314, 272, 273

[56] References Cited

U.S. PATENT DOCUMENTS

| | | | |
|---|---|---|---|
| 3,370,844 | 2/1968 | Roberts . | |
| 3,473,035 | 10/1969 | Gardner et al. | 271/265.02 |
| 3,744,790 | 7/1973 | Hoffman | 271/176 |
| 3,761,078 | 9/1973 | DiFrank et al. | 271/176 |
| 4,251,000 | 2/1981 | Templeton | 271/303 |
| 4,648,591 | 3/1987 | Osmera et al. . | |
| 4,770,405 | 9/1988 | Fukishima et al. | 271/176 |
| 4,793,605 | 12/1988 | Tajima . | |
| 4,814,825 | 3/1989 | Johdai et al. | 271/265.01 |
| 4,858,908 | 8/1989 | Yamada | 271/176 |
| 4,909,374 | 3/1990 | Skrypalle . | |
| 4,963,567 | 10/1990 | Fukui | 271/265.01 |
| 5,110,104 | 5/1992 | Wakao et al. | 271/176 |
| 5,204,537 | 4/1993 | Bennet et al. . | |
| 5,328,169 | 7/1994 | Mandel . | |
| 5,342,038 | 8/1994 | Suter . | |
| 5,478,062 | 12/1995 | Horiuchi et al. | 271/176 |
| 5,478,064 | 12/1995 | Kalisiak . | |
| 5,535,012 | 7/1996 | Matsumoto et al. | 271/176 |
| 5,575,469 | 11/1996 | Coombs et al. | 271/176 |

FOREIGN PATENT DOCUMENTS

| | | | |
|---|---|---|---|
| 2-56352 | 2/1990 | Japan | 271/176 |

*Primary Examiner*—Dean Kramer
*Assistant Examiner*—Thuy V. Tran
*Attorney, Agent, or Firm*—Price, Gess & Ubell

[57] ABSTRACT

A modular paper mover is disclosed which is adapted for use with existing printers and other paper processing devices. The invention included a wedge shaped opening which is located at the exit port of the paper processing device such that paper dispelled from the device will automatically enter the paper mover. A sensor, such as an optical sensor, detects the presence of the paper and is coupled with a motor which drives a platen. The platen acts like a pinch roller to grasp and pull the paper through a track and direct the paper to an outlet location typically opposite the wedge-shaped opening. The motor is designed to operate for a predetermined time interval to insure that the paper is completely clear of the platen even after the sensor is no longer activated. A preferred embodiment of the present invention is sized to sit inside a designated paper well of a paper processing device, providing a modular, removable paper mover which can be used with a variety of paper processing devices.

7 Claims, 3 Drawing Sheets

ADD-ON MODULAR PAPER MOVER

BACKGROUND OF THE INVENTION

1. Field of the Invention

The present invention relates to paper transport, and more particularly to a modular paper mover adapted for use with desktop printers and the like.

2. Description of Related Art

Computers and their peripherals have become common place in many business applications and in many cases have replaced humans in preliminary customer service applications. Computer screens with menu interfaces are useful in assisting customers and an efficient method of doling out general information. In a typical arrangement, a kiosk is located in an accessible place and a computer screen displays menus for customers to read and request information. Examples of such arrangements include banks, department stores, information booths, and other places where customers can be preliminarily handled by a computer rather than a person. In many situations, a printer is connected to a computer either locally or at a distant location for printing information to the requester, where the printer is located in the kiosk or in some area sheltered or secured from the public. For example, a printer may be placed in a kiosk near a computer display screen where information can be dispensed on command to a customer interfacing with the computer. Similarly, printers can be located beyond a wall where interested patrons can request a computer printout and receive the printout though an orifice in the wall. A problem may arise if the printer does not adequately transport the paper from inside the kiosk or behind the wall to the person requesting the printout, resulting in paper jams, wasted paper, and frustration on the requester's part. Typical desktop printers output paper to a reservoir either on top of the printer or immediately adjacent the printer. The art lacks a versatile and simple mechanism for delivering paper from a printer's output destination to a position beyond the printer's immediate perimeter.

What is needed is a unit which is adaptable to common desktop printer and which can move the printed paper from the desktop printer reservoir to a position where it can be dispensed through an opening such as a port in a kiosk. The unit should be compatible with a wide range of current printers on the market, be of simple construction, and handle different size paper easily.

SUMMARY OF THE INVENTION

The object and general purpose of the present invention is accomplished by a modular paper mover which receives paper output from a desktop printer and using a series of rollers "moves" the paper such that when the printer is placed next to an outlet port the paper mover can extend the paper through the port. A primary feature of the present invention is its modular construction and its compatibility with existing desktop printers. The present invention comprises a wedge shaped inlet which is positionable at the outlet of a desktop printer and includes a sensor for detecting the presence of a sheet of paper. The sensor is coupled to a motor which operates a drive roller to withdraw the paper as it exits the printer's exit port and communicates the paper via said roller to a location at the extreme end of the paper mover. In a preferred embodiment, the motor operates on a timer once the motor is activated by the sensor to ensure transportation of the paper from the printer's exit port to the end of the paper mover after the paper has left the sensor's influence.

BRIEF DESCRIPTION OF THE DRAWINGS

The exact nature of this invention, as well as its objects and advantages, will become readily apparent upon reference to the following detailed description when considered in conjunction with the accompanying drawings, in which like reference numerals designate like components throughout the figures thereof, and wherein.

DETAILED DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the general principles of the present invention have been defined herein specifically to provide a paper mover adapted to be used with a desktop printer for moving paper to a location outside of the printer's periphery.

Figure 1:
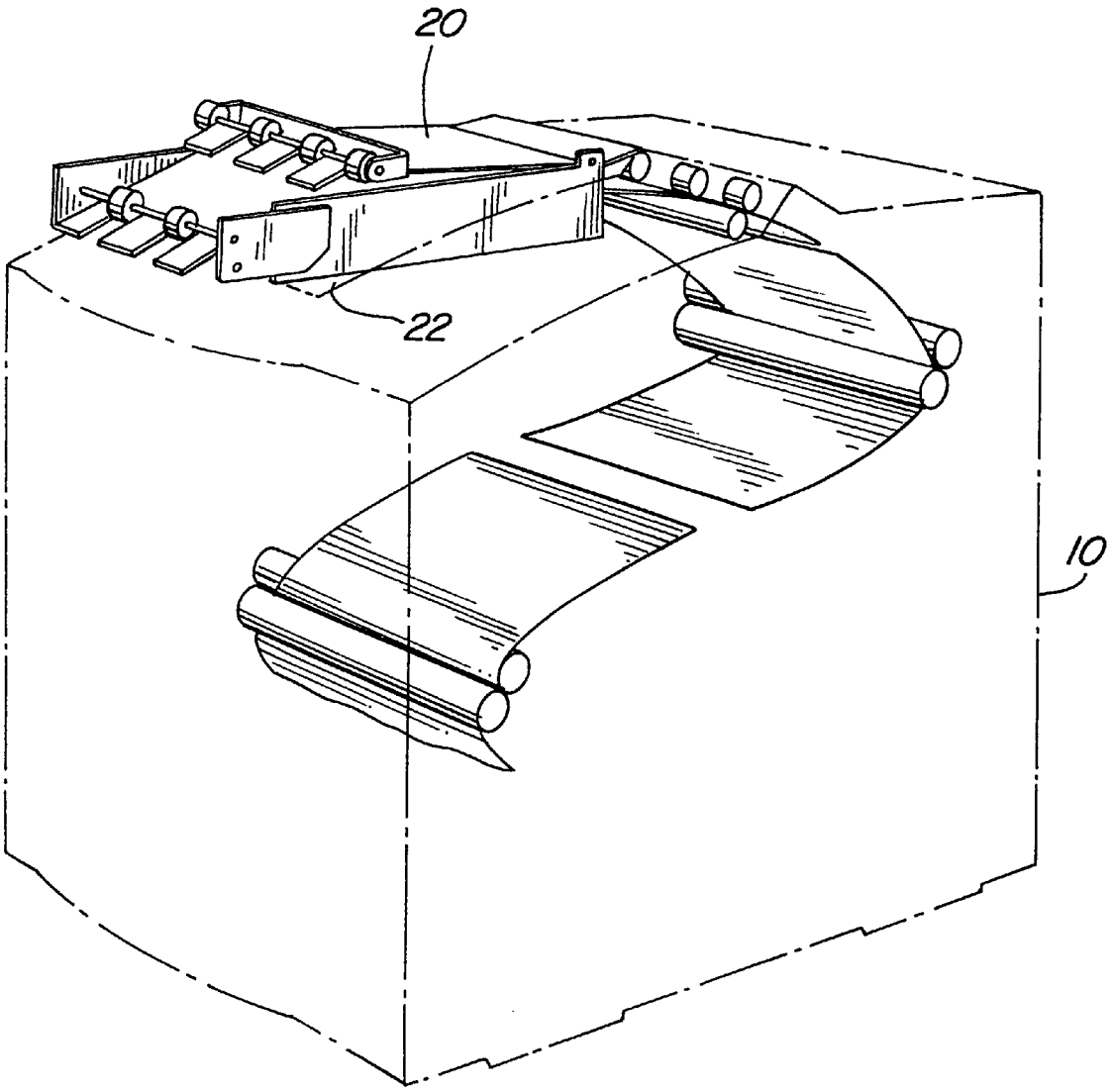
FIG. 1 is an elevated perspective view of the modular paper mover and a common desktop printer in phantom.

A preferred embodiment of present invention is illustrated generally in FIG. 1 which shows a common desktop printer 10 in phantom along with the paper mover 20. As shown, the paper mover 20 is sized to fit within the well 22 of the desktop printer 10 designated as a receptacle for the output paper stack, allowing the paper mover 20 to be easily adapted for use with a large number of desktop printers without further modification. This modular feature, which enables the present invention to be added on to existing printers, is not shown in the existing art of paper movers.

Figure 2:
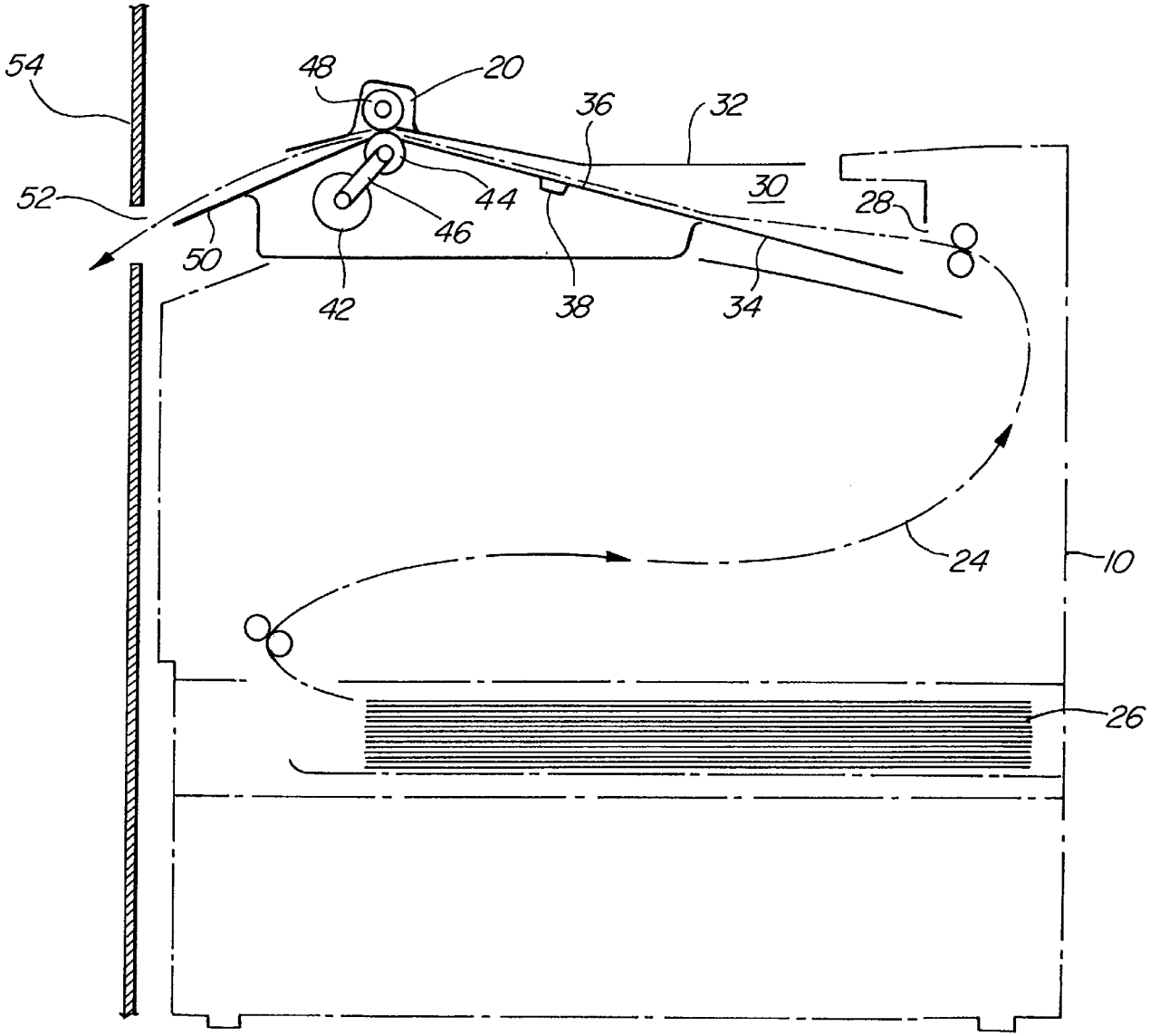
FIG. 2 is a side cut away view of the interaction between the paper mover and the desktop printer.

Turning now to FIG. 2, the path 24 of a sheet of paper is schematically traced from a feed tray 26 through the printer to the exit port 28, where previously it would be deposited in the designated receptacle. The paper mover 20 of the present invention occupies this receptacle thus enabling the paper mover to receive the paper sheets as they exit the printer 10. A wedge-shaped opening 30 formed by an upper platform 32 and a lower platform 34 faces the exit port 28 of the printer 10 and guides the paper into the paper mover's inlet 36. An optical sensor 38 is located at the end of the wedge shaped opening 30 to alert the paper mover that a paper is present so that the motor (not shown) is not operating unnecessarily. When the sensor senses a sheet of paper, the motor engages and turns the drive shaft 42 in the indicated direction, which in turn rotates the platen 44 in the same direction. The platen 44 is connected to the drive shaft 42 using a belt or chain 46, and the platen 44 cooperates with a follower roller 48 to pinch the sheet of paper and pull the sheet between and through the rollers. In a preferred embodiment, the motor continues to operate for several seconds after the end of the sheet has passed the sensor to ensure that the sheet has been fully transported between the rollers. Upon exiting the rollers, the sheet of paper is guided along an exit platform 50 where the sheet may be accessed through an opening 52 in a partition 54 between the printer 10 and a person on the other side of the partition.

Figure 3:
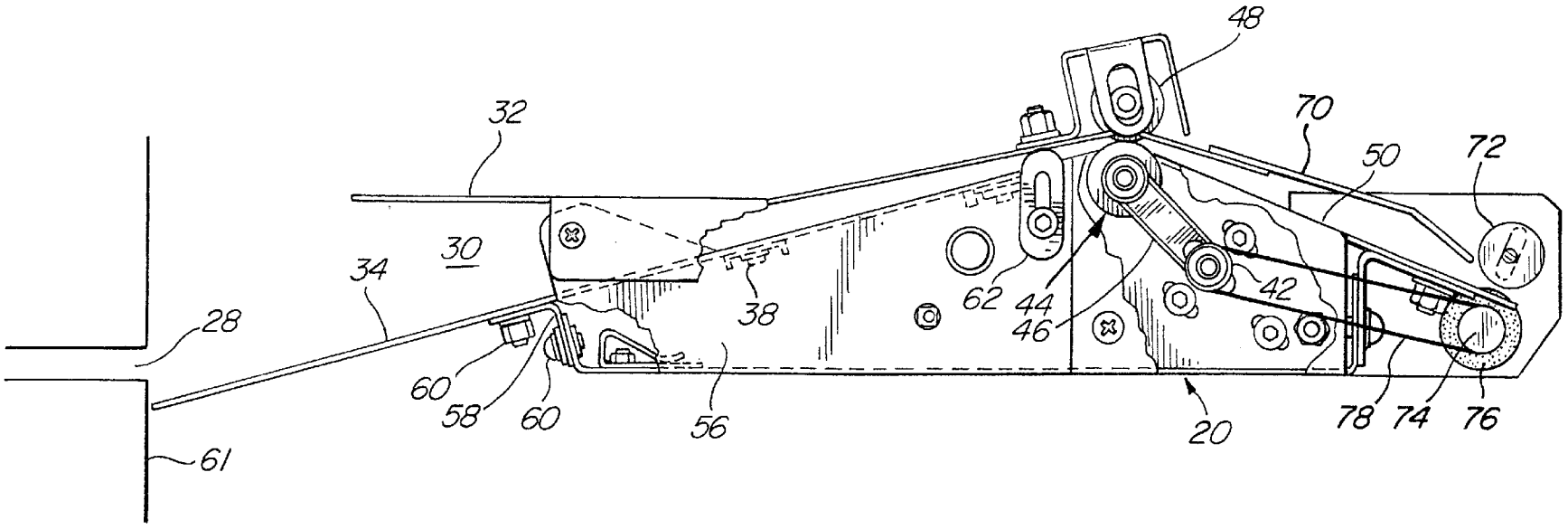
FIG. 3 is a detailed cut away side view of the paper mover of the present invention.

Turning to FIG. 3, a more detailed view of the paper mover 20 is shown. The lower platform 34 which forms the wedge shaped opening 30 is mounted to the housing 56 using an L-shaped bracket 58 and fasteners 60. The lower platform 34 abuts against the printer's edge 61 just below the paper port 28 to prevent paper from slipping under the platform 34. The upper platform 32 is shorter than the lower platform 34 and mounts to the housing 56 at brackets 62 which connect to the lower platform creating the spacing for the wedge shaped opening. A sensor 38, such as a reflective sensor known in the art, detects the presence of a sheet of paper by sensing the reflection of light off the sheet of paper, which signals the electric motor to engage. The motor, which can be a 12V DC motor or any suitable substitution, receives the signal from the sensor 38 and begins to cause the drive shaft 42 to rotate. The drive shaft 42 is connected to the platen 44 by a belt assembly 46 which causes the platen 44 to rotate in conjunction with the drive shaft 42. A follower roller 48 is located above the platen 44 and positioned to contact the platen as it turns, forming a pinch roller mechanism between the two rollers. When a sheet of paper reaches the junction between the two rollers, the rollers pull the sheet of paper between and through them in a continuous manner until the sheet is passed completely between the rollers. As the sheet exits the rollers, it encounters a platform 50, which slopes gently downward to encourage the sheet of paper to continue away from the rollers to avoid congestion at the roller exit.

FIG. 3 illustrates a preferred embodiment which includes a second roller 76 driven by the same motor as above to further control and direct the distribution of the paper. A deflector shield 70 is mounted to the housing, and the shield is orientated to guide the paper exiting the rollers 44, 48 to a second set of rollers 72, 76. Roller 76 is driven by belt 78 which is connected to drive shaft 42 in a standard pulley arrangement. Shaft 74 extends from roller 76 and belt 78 mounts thereto. As the drive shaft 42 rotates, roller 76 is rotated in the same direction. Idler roller 72 is adjustably mounted to accommodate different paper sizes, and the two rollers 76, 72 cooperate to receive and eject the paper exiting roller 44 and roller 48.

The configuration of the housing 56 is designed to fit within the receptacle of the printer which holds the printed pages and the entire unit may be removed and replaced without modification or connection. That is, the unit simply lies on top of the printer 10 and operates without any further connection. The lack of hardware connections allows the unit to be used with a wide variety of desktop printers since no additional connecting components, wires, brackets, etc. is needed. The present invention is of simple yet effective construction and can work easily with different sized pages without adjustments. On the other hand, the unit can be modified to meet specific delivery specifications by changing the length of the platforms and even the number of rollers. That is, more than one set of rollers can easily be configured to move the paper at a greater distance that that shown here without deviating from the present invention.

It will be understood that the embodiment described herein are merely exemplary and that a person skilled in the art may make many variations and modifications without departing from the spirit and scope of the invention. All such variations and modifications are intended to be included within the scope of the invention as defined in the appended claims.

What is claimed is:

1. A modular paper moving unit for transporting paper from a paper processing device exit port to a new destination comprising:

a housing seated on and positioned adjacent the exit port of the paper processing device without any fixtures for connecting to said paper processing device;

a sensor mounted to said housing for detecting the presence of a sheet of paper dispelled from said exit port;

a motor coupled to said sensor to engage when said sensor detects the presence of a sheet of paper; and rollers driven by said motor for moving said sheet of paper from said exit port to said new destination.

2. The modular paper moving unit as recited in claim 1 wherein said housing is sized to be seated in and operate within a designated paper receptacle on said paper processing device.

3. The modular paper moving unit as recited in claim 2 wherein said housing further comprises a first platform extending to said exit port, said first platform operating to guide said sheet of paper from said exit port to said rollers for moving said sheet of paper.

4. The modular paper moving unit as recited in claim 3 wherein said housing further comprises a second platform extending to said exit port wherein said first platform extends to a position slightly below said exit port and said second platform extends to a position slightly above said exit port, said first and second platforms forming a wedge-shaped opening for receiving said sheet of paper from said exit port.

5. The modular paper moving unit as recited in claim 4 wherein said sensor comprises an optical sensor adapted to detect if a sheet of paper is interposed between said first and second platforms.

6. The modular paper moving unit as recited in claim 5 wherein said motor engages for a predetermined time after said sensor detects the presence of a sheet of paper to ensure that the sheet of paper is completely pulled through said rollers for moving said sheet of paper.

7. A modular paper moving apparatus comprising:

a housing seated on a paper processing machine without fixtures connecting said housing to said paper processing machine, said housing including first and second panels forming a wedge-shaped opening;

a sensor on one of said first and second panels to detect the presence of a sheet of paper between said first and second panels;

a pair of rollers positioned adjacent said wedge-shaped opening to guide a sheet of paper thereinbetween, said pair of rollers rotating in opposite directions when said sensor senses a presence of a sheet of paper to move said paper between and past said pair of rollers.

* * * * *